United States Patent [19]

Matsushita et al.

[11] Patent Number: 4,474,898

[45] Date of Patent: Oct. 2, 1984

[54] PRESSURE-SENSITIVE COPYING PAPER OF "TRANSFER TO PLAIN PAPER" TYPE

[75] Inventors: Toshihiko Matsushita, Funabashi; Shigetoshi Hiraishi, Tokyo; Sadao Morishita, Inashiki, all of Japan

[73] Assignee: Mitsubishi Paper Mills, Ltd., Tokyo, Japan

[21] Appl. No.: 513,146

[22] Filed: Jul. 12, 1983

[30] Foreign Application Priority Data

Jul. 16, 1982 [JP] Japan ..... 57-124005

[51] Int. Cl.[3] ..... B41M 5/16

[52] U.S. Cl. ..... 503/203; 428/914; 503/209; 503/214

[58] Field of Search ..... 282/27.5; 427/150–153; 428/320.4–320.8, 411, 484, 488, 537, 913, 914

[56] References Cited

U.S. PATENT DOCUMENTS 3,924,041 12/1975 Miyayama et al. ..... 428/913
4,273,602 6/1981 Kosaka et al. ..... 428/913
4,352,855 10/1982 Hiraishi et al. ..... 428/320.4

FOREIGN PATENT DOCUMENTS 53-16728 6/1978 Japan ..... 503/214
54-126111 10/1979 Japan ..... 503/214
54-159008 12/1979 Japan ..... 503/214

*Primary Examiner*—Bruce H. Hess
*Attorney, Agent, or Firm*—Cushman, Darby & Cushman

[57] ABSTRACT

A pressure-sensitive copying paper of "transfer to plain paper" type obtained by coating a mixture comprising (a) a colorless to light-colored electron-donating color former, (b) a colorless to light-colored electron-accepting color developer giving a colored product by reacting with said color former (a), (c) a wax and (d) a polyvinyl ether, on one side of a support and drying the coated support, provides an advantage which conventional copying papers of "transfer to plain paper" type do not possess, in that the density of a transfer image formed on a plain paper is higher than that of a reverse image formed on the coated side of a copying paper.

3 Claims, No Drawings

PRESSURE-SENSITIVE COPYING PAPER OF "TRANSFER TO PLAIN PAPER" TYPE

This invention relates to a pressure-sensitive copying paper capable of forming a copy image on a plain paper.

Conventional type pressure-sensitive copying paper comprise (a) an upper sheet being a support whose lower side is coated with microcapsules containing a core material of a colorless or light-colored electron-donating color former dissolved in a non-volatile oil and the like and (b) a lower sheet being a support whose upper side is coated with a colorless or light-colored electron-accepting color developer. By allowing the coated sides of these two sheets to face each other and applying a local pressure on the upper side (non-coated side) of the upper sheet by the use of a writing material, a typewriter or the like to print an original image, a copy image can be formed on the upper side of the lower sheet. A plurality of copy images can be obtained by inserting a necessary number of intermediate sheets each being a support whose upper side is coated with a color developer and whose lower side is coated with microcapsules containing a color former, between the upper sheet and the lower sheet. Since these pressure-sensitive copying papers do not use colored substances, they do not stain hands and/or clothes and are widely used for clerical and other purposes. However, these papers need be used in the combination of at least two and ordinarily three coated sheets, namely, an upper sheet, an intermediate sheet and a lower sheet. In addition, copy images can be obtained only on the color developer-coated sides of the intermediate sheet and the lower sheet.

Also, there is another type of a pressure-sensitive copying paper wherein both color former-containing microcapsules and a color developer are coated on the same one side, namely, a so-called self-contained pressure-sensitive copying paper.

In the self-contained pressure-sensitive copying paper, even if its coated side is superposed on a plain paper and local pressure is applied on the non-coated side of the copying paper, a reverse image is formed on the coated side of the copying paper but no copy image is transferred to the plain paper.

The plain paper mentioned herein refers to a paper whose one side to be subjected to image transfer is not coated with an electron-donating color former or an electron-accepting color developer.

Pressure-sensitive coating papers wherein both a color former and a color developer are coated on the same one side of a support and whereby a copy image can be transferred onto a plain paper, are disclosed in Japanese Patent Application Kokai (Laid-open) No. 126111/1979, Japanese Patent Publication No. 16728/1978 and Japanese Patent Application Kokai (Laid-open) No. 159008/1979.

In Japanese Patent Application Kokai (Laid-open) No. 126111/1979, a solid color former and a solid color developer are added to a wax to obtain a coating color, and the color is coated on a support as a single layer. This coating color causes a color development reaction and develops a color right after the color former and the color developer have been mixed. That is, the above invention relates to a pressure-sensitive copying material having a colored coated layer similar to the so-called back carbon paper. Since the coated layer has a color, the copying material has a disadvantage in appearance.

Japanese Patent Publication No. 16728/1978 utilizes color development by a chelate. Capsules containing a reactant are coated on a support and thereon a solution of a coreactant dissolved in a solvent is coated. Since a solvent is used, the microcapsule shell must be resistant to the solvent and hence usable shell materials are restricted. The pressure-sensitive copying paper disclosed in the above invention has various disadvantages in environmental and economic aspects.

In Japanese Patent Application Kokai (Laid-open) No. 159008/1979, a wax is used. That is, microcapsules containing a color former dissolved in an oil are coated, as the first layer, on a support together with a binder and further thereon a layer containing a wax and a color developer is coated as the second layer. In this copying paper, the microcapsule layer is first coated by the use of an air-knife coater or the like and then the color developer is coated, and hence the operation includes one additional step increasing the production cost. Further, because the microcapsule layer is coated on a support together with a binder as so in the upper sheet of an commercially-available pressure-sensitive copying paper, transfer of this layer to a plain paper hardly occurs; capsules are destroyed at the time of printing an original image and a part of the color former-containing oil liberated migrates into the support and thereby the quantity of the color former taking part in color development becomes less; and thus the copying paper according to the above invention is disadvantageous in transferability and color developability.

Meanwhile, the present inventors disclosed in Japanese Patent Application Kokai (Laid-open) No. 123893/1981 a pressure-sensitive copying paper of "transfer to plain paper" type wherein two kinds of waxes are used together. By superposing this copying paper on a plain paper and appying a local pressure on the side of the copying paper not contacting the plain paper, a sharp copy image is formed on the plain paper. However, ar this time, a reverse image formed on the coated side of the copying paper (i.e. the side contacting the plain paper) also gives a high density, and this is not desirable from its balance with the density of the copy image transferred onto the plain paper. Further, two kinds of waxes, namely, a wax of a fatty acid amide having 14 or less carbon atoms or an unsaturated fatty acid amide and another kind of a wax have to be used together and it is troublesome.

In order to solve the above drawbacks, the present inventors continued further studies. As a result, by coating a mixture comprising (a) a colorless to light-colored electron-donating color former, (b) a colorless to light-colored electron-accepting color developer giving a colored product by reacting with said color former (a), (c) a wax and (d) a polyvinyl ether, on one side of a support and drying the coated support, there could be developed a colorless pressure-sensitive copying paper of "transfer to plain paper" type which can form a copy image on a plain paper with excellent transferability and color developability.

According to this invention, by adding a polyvinyl ether, the unintentional color development of the coated side of the copying paper could be suppressed and the color density of the reverse image formed on the coated side of the copying paper when a local pressure is applied could be reduced at a lower level than that of the copy image transferred onto the plain paper without the co-use of a sensitivity-reducing amide wax and another kind of a wax.

As another advantage of this invention, the polyvinyl ether can be utilized as a binder to the support.

Further, because the polyvinyl ether has also a characteristic as softener, the extent of color development caused by bending of the copying paper of this invention is low.

The polyvinyl ether used in this invention is effective when it is used in the quantity of 0.001 to 10% by weight based on the total quantity of the color former, the color develooer and the wax. It is preferably used in the quantity of 0.01 to 5% by weight.

As the polyvinyl ether used in this invention, there can be mentioned polyvinyl methyl ether, polyvinyl ethyl ether, polyvinyl propyl ether, polyvinyl butyl ether and polyvinyl isobutyl ether.

As the color former used in this invention, there can be mentioned a colorless or light-colored electron-donating organic compound. There can be used alone or in combination, for example, triarylmethane compounds such as 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3-(p-dimethylaminophenyl)-3-(2-phenylindole-3-yl)phthalide, 3,3-bis(9-ethylcarbazole-3-yl)-5-dimethylaminophthalide and the like; dimethylmethane compounds such as 4,4'-bis-dimethylaminobenzhydrin benzyl ether, N-halophenyl-leuco-Auramine, N-2,4,5-trichlorophenyl-leuco-Auramine and the like; xanthene compounds such as Rhodamine B-anilinolactam, 3-dimethylamino-7-methoxyfluoran, 3-diethylamino-7-chlorofluoran, 3-diethylamino-6,8-dimethylfluoran, 3-diethylamino-7-methylaminofluoran, 3,7-diethylaminofluoran, 3-diethylamino-7-dibenzylaminofluoran, 3-diethylamino-chloroethylmethylaminofluoran and the like; thiazine compounds such as benzoyl Leuco Methylene Blue, p-nitrobenzyl Leuco Methylene Blue and the like; spiro compounds such as 3-methyl-spirodinaphthopyran, 3-ethylspirodinaphthopyran, 3,3'-dichlorospirodinaphthopyran, 3-propyl-spirodibenzopyran and the like; and so forth.

As the color developer, there can be used a colorless or light-colored electron-accepting substance. It includes, for example, inorganic acidic substances such as diatomaceous earth, activated clay, kaolin, zeolite, bentonite, attapulgite and the like; color developers of phenol type such as substituted phenols, phenol-formalin condensation products, alkyl-substituted phenol-formalin condensation products, aryl-substituted phenol-formalin condensation products and the like as well as their metal salts; color developers of benzoic acid type such as benzoic acid, chlorobenzoic acid, toluic acid, salicylic acid, 5-tert-butylsalicylic acid, 3,5-di-tert-butylsalicylic acid, 3,5-di($\alpha$-methylbenzyl)salicylic acid and the like as well as their metal salts; and so forth. These substances can be used alone or in combination. When the color developer is used in the form of microcapsule, an oil-soluble color developer of phenol or salicylic acid type is preferable.

The color former and/or the color developer is microencapsulated by one of the methods known in the art. These methods include the monomer polymerization method, the phase separation method, the spray dry method and the like. As film-forming shell materials, there can be used gelatin, casein, gum arabi, rosins, starch, collagen, sodium alginate, ethyl cellulose, carboxymethyl cellulose, benzyl cellulose, polyvinyl alcohol, polyethylene, polyamide, polyester, polyurethane, polyacrylic amide, polyethyleneimine and the like. Substances other than these can be used.

As the non-volatile oil used for microencapsulation there are various oils of alkylnaphthalene type, chlorinated paraffin type, diarylethane type, alkyldiphenyl type, aromatic ester type, aliphatic ester type and the like. These oils can be used alone or in combination.

The wax used in this invention can be selected from among animal waxes such as beeswax, spermaceti, Chinese insect wax, lanolin and the like; vegetable waxes such as candelilla wax, carbauba wax, Japan wax, rice wax, sugarcane wax and the like; mineral waxes such as montan wax, ozokerite, ceresine, lignite wax and the like; petroleum waxes such as paraffin wax, microcrystalline wax and the like; modified waxes such as montan wax derivative, paraffin wax derivative, microcrystalline wax derivative and the like; hydrogenated waxes such as castor wax, opal wax and the like; low molecular weight polyethylenes and their derivatives; synthetic waxes such as acra wax, distearyl ketone and the like; waxes of saturated fatty acid amide type such as capronamide, caprylamide, pelargonamide, capramide, lauramide, tridecylamide, myristamide, stearamide, behenamide, ethylenebisstearamide and the like; waxes of unsaturated fatty acid amide type such as caproleamide, ricinoleamide, myristoleamide, oleamide, elaidamide, linolamide, erucamide, ricinoleamide, linoleamide and the like; and so forth. These waxes may be used alone or in combination.

The pressure-sensitive copying paper of this invention can be produced by the method wherein a coating color dispersed in water is coated on a whole surface of a support by the use of an ordinary coater such as air-knife coater; the method wherein microcapsules are dried by spray drying or the like, the dried microcapsules are uniformly mixed with a wax, to which a fine powder of a color former or a color developer is optionally added, at a melting temperature of the wax to obtain a coating color, which is coated on a part of a support by the use of an ordinary carbon printer or the like; the method wherein microcapsules are spray-dried and dispersed in an organic solvent to obtain an ink, which is subjected to spot printing by the flexographic printing; and so forth. Any method of these can be selected optionally.

In this invention, at the time of preparing the coating color, modifiers can be added to the color so that it has properties suitable for the coater or printer to be used. For example, a thickener is added to obtain a desired viscosity and a surfactant is used to improve dispersion. Other modifiers can also be added as necessary.

As the support on which a coated layer is formed, paper is used mainly. Also used are various nonwoven fabrics, plastic films, synthetic papers, metal foils and the like as well as composite sheets thereof.

This invention will be explained specifically below by referring to Examples. Parts in Examples refer to parts by weight.

EXAMPLE 1

(a) A dispersion of microcapsules containing a color former was prepared as follows.

6 Parts of 3-diethylamino-6-methyl-7-phenylaminofluoran was dissolved in 94 parts of Hisol SAS N296 (diarylethane type solvent manufactured by Nippon Petrochemicals Co., Ltd.) to obtain a color former solution. This solution was emulsified in 200 parts of 5% aqueous ethylene-maleic anhydride copolymer solution and the pH of the emulsion was adjusted to 4.0. Thereto was added 200 parts of an aqueous solution dissolving 10 parts of urea and 2 parts of resorcin. Further there was added 25 parts of 37% aqueous formalin solution. Then, the temperature of the resulting mixture was kept at 55° C. and the mixture was subjected to reaction for 3 hr. Subsequently, the reaction mixture was cooled and its pH was adjusted to 8.0, whereby a dispersion of microcapsules containing a color former was obtained.

(b) A dispersion of microcapsules containing a color developer was prepared as follows.

There were mixed 100 parts of an aqueous solution containing 10% of an ethylene-maleic anhydride copolymer, 10 parts of urea, 1 part of resorcin and 200 parts of water. The pH of this mixture was adjusted to 3.5 by using 20% aqueous sodium hydroxide solution.

Separately, 60 parts of a p-phenylphenolformalin resin was dissolved in 140 parts of diisopropylnaphthalene, whereby a color developer solution was obtained.

The color developer solution was emulisifed in the above prepared aqueous solution and diameters of liquid droplets were made to 3 to 5μ. Then, 25 parts of 37% aqueous formalin solution was added and, while stirring, the temperature of the reaction system was kept at 55° C. After 2 hr of reaction, the system was cooled and its pH was adjusted to 9.5, whereby a dispersion of microcapsules containing a color developer was obtained.

(c) By using the dispersion of microcapsules of a color former prepared in (a) and the dispersion of microcapsules of a color developer prepared in (b), an aqueous coating color was prepared as follows. Each part represents a solid content.

| | |
|---|---|
| Dispersion of color former-containing microcapsules | 10 parts |
| Dispersion of color developer-containing microcapsules | 18 parts |
| Paraffin wax emulsion | 12 parts |
| Polyvinyl methyl ether | 2 parts |
| Wheat starch | 10 parts |
| SBR latex | 8 parts |

This aqueous coating color was diluted with water so that the solid content became 20% by weight, whereby a final aqueous coating color was obtained.

This aqueous coating color was coated on a base paper of 48 g/m$^2$ by the use of a Mayer bar so that the coated quantity became 6 g/m$^2$, whereby there was obtained a pressure-sensitive copying paper of "transfer to plain paper" type having a colorless coated layer. The coated layer of the copying paper obtained was superposed on a plain paper and printing was made on the non-coated side of the copying paper by the use of an IBM 82 C typewriter at a printing pressure of No. 5, whereby a distinct black image was formed on the plain paper. The image on the plain paper was more distinct and darker than the image (reverse image) on the coated side of the copying paper.

EXAMPLE 2

The capsule dispersions (a) and (b) obtained in Example 1 were converted to a capsule powder, respectively, by the spray drying method. Using these capsule powders and also wax and polyvinyl ethyl ether, an ink for flexographic printing was prepared as follows. Each part represents a solid content.

| | |
|---|---|
| Color former-containing microcapsules | 8 parts |
| Color developer-containing microcapsules | 15 parts |
| Microcrystalline wax | 10 parts |
| Polyvinyl ethyl ether | 1.65 parts |
| Wheat starch | 9 parts |
| Acrylic resin | 8.5 parts |

These materials were mixed and dispersed in ethanol, whereby an ink for flexographic printing containing 25% by weight of a solid content was obtained. This ink was subjected to spot printing on a base paper of 48 g/m$^2$ by the use of a flexographic printer so that the coated quantity became 4.0 g/m$^2$, whereby there was obtained a pressure-sensitive copying paper of "transfer to plain paper" type having a colorless coated layer. The coated side of the copying paper obtained was superposed on a plain paper and solid printing was made on the non-coated side of the copying paper by the use of an IBM 82 C typewriter at a printing pressure of No. 5, whereby a distinct black solid image was formed on the plain paper. The image on the plain paper was more distinct and darker than the image (reverse image) on the coated side of the copying paper.

EXAMPLE 3

(a) A dispersion of microcapsules containing a color former was prepared in the same manner as in Example 1(a), except that 3-diethylamino-6-methyl-7-phenylaminofluoran was replaced by Crystal Violet Lactone.

(b) As the color developer, a p-octylphenol resin was used. The resin was wet-ground in a ball mill for 24 hr to obtain fine particles of 1 to 3μ.

(c) Using the dispersion of color former-containing capsules and the dispersion of the p-octylphenol resin, an aqueous coating color was prepared according to the following formulation. Each part represents a solid content.

| | |
|---|---|
| Dispersion of color former-containing capsules | 15 parts |
| p-Octylphenol resin | 3 parts |
| Oleamide | 6 parts |
| Polyvinyl methyl ether | 0.24 part |
| Wheat starch | 10 parts |
| SBR latex | 7 parts |

These materials were mixed and diluted with water so that the solid content became 20% by weight, whereby a final aqueous coating color was obtained.

This aqueous coating color was coated on a base paper of 48 g/m$^2$ by the use of a Mayer bar so that the coated quantity became 7 g/m$^2$, whereby there was prepared a pressure-sensitive coating paper of "transfer to plain paper" type having a colorless coated layer. The coated side of the copying paper was superposed on a plain paper and printing was made on the non-coated side of the copying paper by the use of an IBM 82 C typewriter at a printing pressure of No. 5, whereby a distinct blue image was formed on the plain paper. The image on the plain paper was more distinct and deeper than the image (reverse image) on the coated side of the copying paper.

What is claimed is:

1. A pressure-sensitive copying paper of "transfer to plain paper" type obtained by coating a mixture comprising (a) a colorless to light-colored electron-donating color former, (b) a colorless to light-colored electron-accepting color developer giving a colored product by reacting with said color former (a), (c) a wax and (d) a polyvinyl ether, on one side of a support and drying the coated support.

2. A pressure-sensitive copying paper of "transfer to plain paper" type according to claim 1, wherein both or either of the color former and the color developer is microencapsulated.

3. A pressure-sensitive copying paper of "transfer to plain paper" type according to claim 1, wherein the polyvinyl ether is selected from the group consisting of polyvinyl methyl ether, polyvinyl ethyl ether, polyvinyl propyl ether, polyvinyl butyl ether and polyvinyl isobutyl ether.

* * * * *